United States Patent [19]

Szendroi

[11] 4,004,702

[45] Jan. 25, 1977

[54] COKE OVEN LARRY CAR COAL RESTRICTING INSERT

[75] Inventor: Imre Szendroi, Allentown, Pa.

[73] Assignee: Bethlehem Steel Corporation, Bethlehem, Pa.

[22] Filed: Apr. 21, 1975

[21] Appl. No.: 570,135

[52] U.S. Cl. ..... 214/35 R; 202/262; 202/263; 222/564

[51] Int. Cl.[2] ..... C10B 31/02

[58] Field of Search ..... 214/35 R, 18 PH; 202/262, 263; 222/564, 575

[56] References Cited

UNITED STATES PATENTS

| | | | |
|---|---|---|---|
| 1,815,897 | 7/1931 | Boynton | 214/35 R X |
| 2,049,817 | 8/1936 | McIntosh | 202/263 |
| 2,075,931 | 4/1937 | Eades | 214/18 PH X |
| 3,368,948 | 2/1968 | Meunier | 202/262 |
| 3,435,596 | 4/1969 | Hornung | 55/223 |
| 3,716,150 | 2/1973 | Echterhoff et al. | 214/35 R |
| 3,791,320 | 2/1974 | Gidick | 202/263 X |
| 3,857,758 | 12/1974 | Mole | 201/40 |

*Primary Examiner*—Albert J. Makay
*Attorney, Agent, or Firm*—Joseph J. O'Keefe; Michael J. Delaney; John J. Selko

[57] ABSTRACT

A removable insert is placed in the collar of larry hoppers to restrict the flowing coal to a column having a dimension less than the interior width of the coking chamber and charging hole to provide space for exhausting charging gases.

6 Claims, 9 Drawing Figures

COKE OVEN LARRY CAR COAL RESTRICTING INSERT

BACKGROUND OF THE INVENTION

This invention relates to the charging of coke ovens, and more particularly, it relates to the removal of gases generated during the charging of single-main coke ovens, in which the charging hole of the coke oven and the interior of the coke chamber are substantially blocked by the column of incoming coal.

During the charging of coal into single-main coke ovens, a temporary increase, or surge, occurs in the volume of gases. This surge is due to the physical displacement of the furnace gases as the coal fills the coking chamber, and due to the evolution of additional gases due to the volatilization of coal. The term charging gases refers to the total volume of gases generated by displacement and by evolution. The oven aspiration system must exhaust these charging gases.

If these charging gases are not removed, the gas pressure builds up in the oven and emission of gas can occur at the nearest portals, such as the coke oven doors and charge holes which are not being used, and therefore, pollution of the amosphere can result.

In a typical coke chamber, substantially all of the charging gases must be removed via the free gas-flow area above the charged coal. The cross-sectional area of this gas-flow area determines the gas velocity, the gas pressures and eventually the emissions to a considerable degree. A greater free gas-flow area permits a lower gas velocity for a given effective gas removal, and makes it easier for the oven aspiration system to remove the charging gases.

However, as the oven fills, the free space cross-sectional area of the gas flow decreases, and the charging gas volume increases. During the time when the free cross-sectional area is decreasing, and the charging gas volume is greatly increasing, it is necessary for the existing aspiration system to provide maximum gas velocity to remove the charging gas from the oven in order to prevent gas emission. Otherwise the gas can seep out into the atmosphere.

However, maximum gas velocity in the gas-flow area tends to vacuum out of the oven and into the aspiration system considerable amounts of fine coal. Build-up of this coal in the aspiration system makes subsequent aspiration even more difficult.

Also, for many single-main coke ovens, the interior width of the chamber is substantially filled by the column of falling coal, and all of the charging gas on the side of the oven away from the collecting main cannot, therefore, pass between the chamber wall and the coal column. Because of its inability to flow to the collecting main, a portion of the charging gas gets trapped in the coking chamber, and builds up pressure, and eventually seeps out into the atmosphere.

The coal falling into the ovens falls as a columnar mass whose horizontal cross-sectional dimensions are controlled by the minimum horizontal cross-sectional dimensions of the charging hole. In the ovens to which this invention relates, the minimum dimensions of the charging hole are the same as the corresponding minimum dimensions of the collar and bottom discharge opening of the larry car hopper feeding the oven, and the column of in-coming coal substantially blocks the interior width of the coking chamber.

SUMMARY OF INVENTION

It is an object of this invention to provide a device on a single-main coke oven to provide increased space in the coking chamber for charging gas movement, to decrease the required velocity of the gases moved by the aspiration system.

It is a further object of this invention to position a device on a larry car for single-main coke ovens to provide space between a column of coal and the coking chamber walls to permit charging gases to freely move the length of the coking chamber to the aspiration system.

It is a still further object of this invention to position a device on larry car hoppers for single-main coke ovens to reduce to the capacity of the existing aspiration system the overall gas displacement rate by reducing the feed rate of incoming coal.

This invention accomplishes these objects by providing a replaceable coal column restriction insert within the collar of the larry car hopper. The insert in one embodiment has a circular orifice which is centered within the collar above the charging hole to restrict the column of coal to a dimension less than the interior width of the coking chamber, to provide adequate space between the column of coal and interior chamber walls to permit the charging gases to freely move the length of the coking chamber to the aspiration system.

In another embodiment, this orifice is elliptical, and positioned within the collar so that the maximum restriction of the column of coal occurs in the direction of the oven cross-section, which is the plane of the interior width of the chamber, and a minimum restriction of the column of coal occurs in a direction of the length of the chamber perpendicular to the oven cross-section, for a greater coal flow.

In still another embodiment, a jumper pipe is connected to the larry car drop sleeve and an adjoining coking chamber, and the insert provides spacing between the incoming column of coal and the oven within the charging hole whereby during charging, the charging gas can simultaneously pass out the charging hole to the jumper pipe and out through the adjoining coking chamber.

DESCRIPTION OF PREFERRED EMBODIMENT

Figures 1, 2, 4, 5, 6, 7, 8, 9:
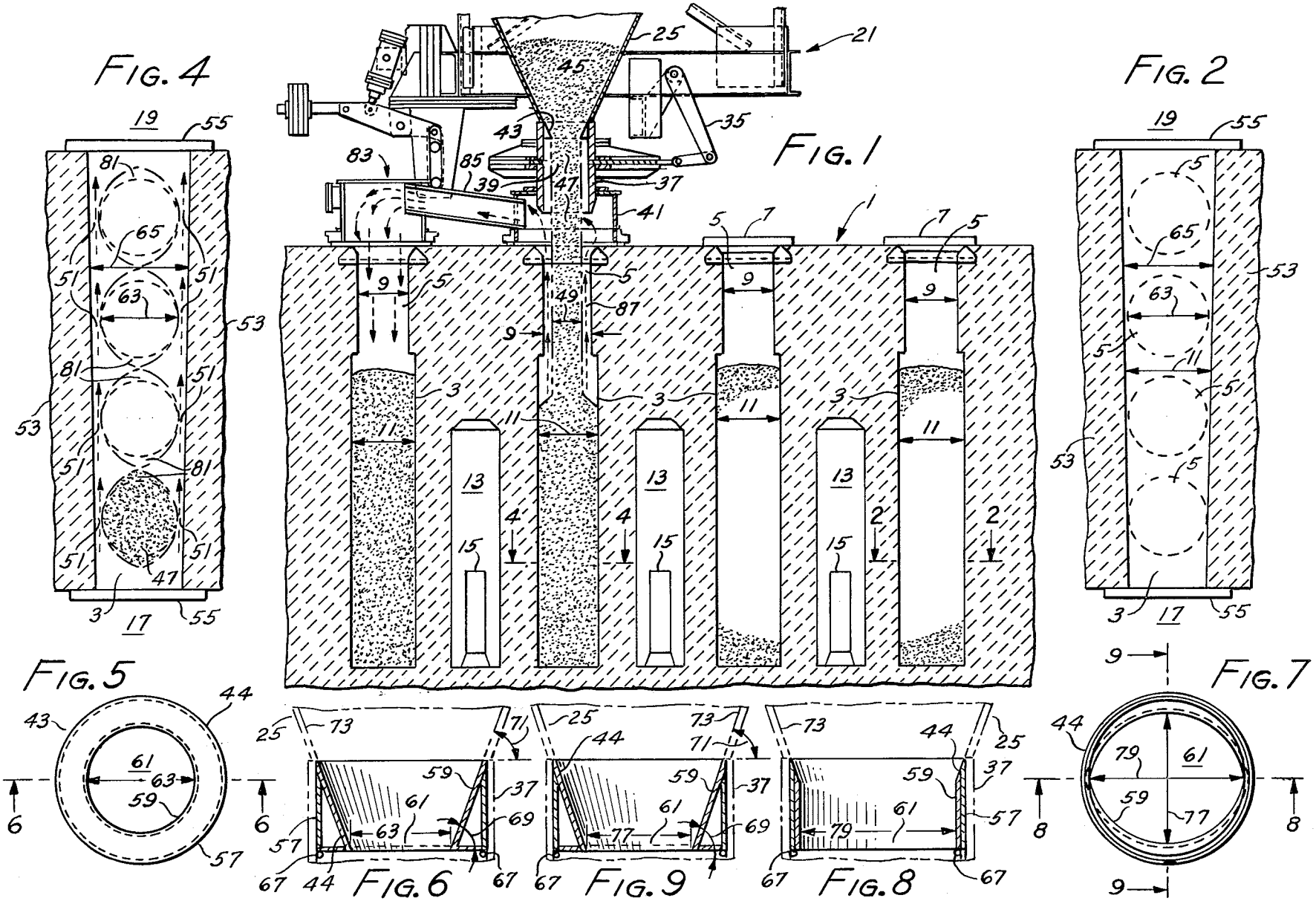
FIG. 1 is a cross sectional elevational view of the coal-charging larry car incorporating the invention, with a plurality of coking chambers shown.
FIG. 2 is view of the coking chamber taken on line 2—2 of FIG. 1, with the outline of the charging holes shown in dotted lines.
FIG. 4 is a view of the coking chamber taken on line 4—4 of FIG. 1, with the outlines of the orifice of the invention shown in dotted lines and dot-dash lines.
FIG. 5 is a plan view of the removable insert of this invention showing a circular orifice.
FIG. 6 is a view of the insert taken along lines 6—6 of FIG. 5.
FIG. 7 is a plan view of the removable insert of this invention showing an elliptical orifice.
FIG. 8 is a view of the insert taken along line 8—8 of FIG. 7.
FIG. 9 is a view of the insert taken along line 9—9 of FIG. 7.

Referring now to the drawings and particularly to FIG. 1 the apparatus of the invention is seen applied to a by-product coke oven battery 1. The coke oven battery 1 comprises a plurality of coking chambers 3 aligned transverse to the longitudinal axis of the coke oven battery. Each coking chamber 3 has a plurality of charging holes 5. The coking chamber 3 shown in the FIGURES has four such charging holes 5. Installations are known where three or five charging holes are provided in the coking chambers 3 and this invention is equally applicable to any arrangement of charging openings as will be evident to those skilled in the art. The charging holes 5 are provided with lids or covers 7 which remain closed except during the charging operation.

Charging holes 5 are usually circular in horizontal cross section and have a minimum diameter 9 equal to or slightly less than the minimum interior width 11 of coking chamber 3 measured in the direction of the oven cross-section, which is a plane along the longitudinal axis of the coke oven battery 1.

Between each coking chamber 3 is a heating wall with flues 13 and burners 15, as is well known.

As shown in FIG. 2, chamber 3 is tapered slightly and increases slightly in width from the pusher side 17 to the coke side 19 of the oven. For a 40 foot long chamber 3, the taper is usually between 2.5 to 4 inches over the length of chamber 3. For each battery, the charging holes 5 are all the same size, as indicated by the dotted lines representing the outline of the charging holes 5 in relation to chamber 3.

Figure 3:
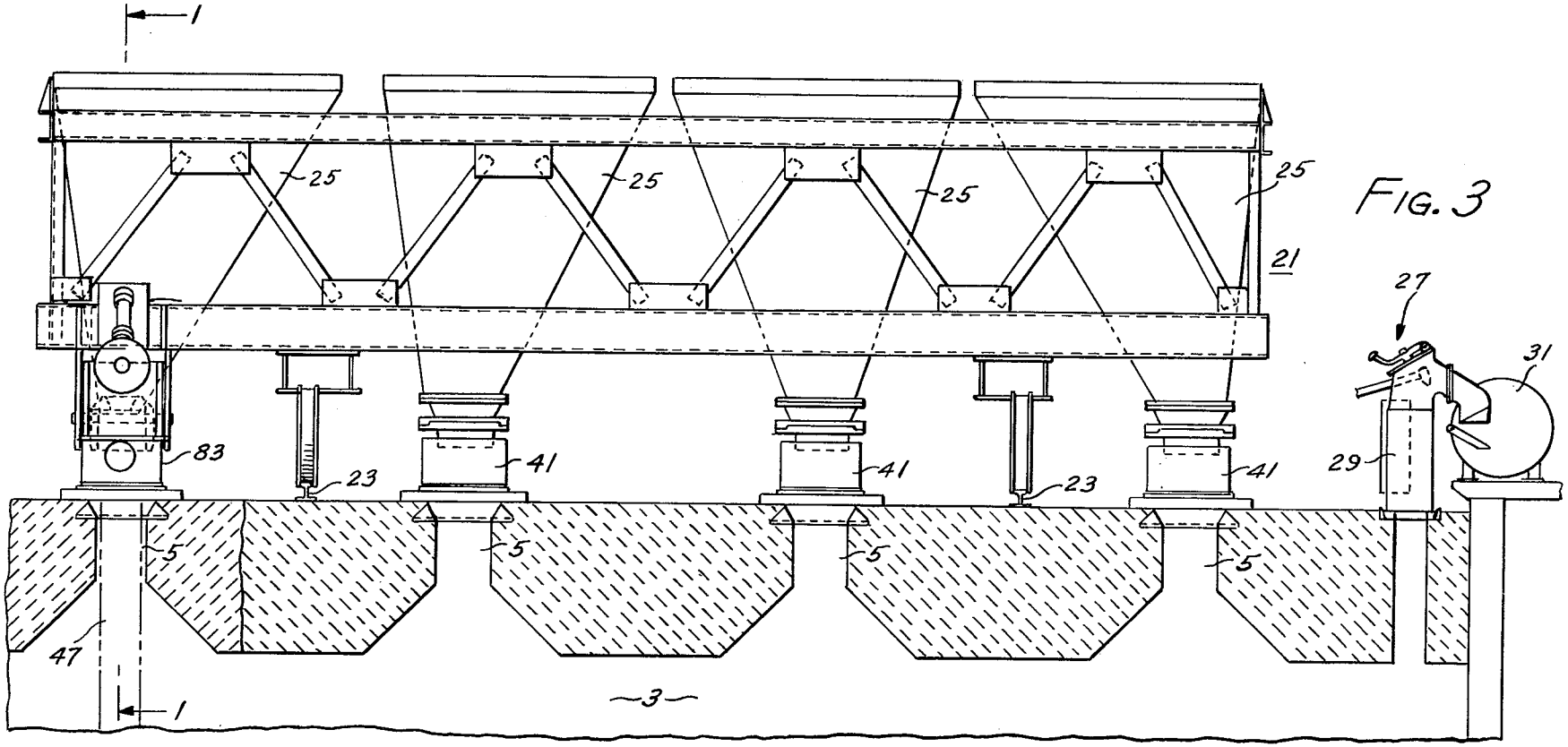
FIG. 3 is an elevational view of a coal charging larry car incorporating the invention with the top of a coking chamber shown in section.

Referring to FIG. 3, a larry car 21 is mounted for traverse along the top of the coke oven battery on rails 23 which are parallel to the length of the battery. These rails permit movement of the larry car back and forth on the top of the coke oven battery between the coal bin (not shown) and the coking chamber 3. Larry car 21 is provided with a number of gravity fed hoppers 25 which are loaded at the coal bin with the desired blend and amount of coal for coking.

Located at one end of chamber 3, is a conventional aspiration system 27 including ascension pipe 29, collection main 31, and steam ejection system 33 for creating negative pressure in chamber 3 as is well known.

Referring again to FIG. 1, each larry car 21 is provided with gate means 35 of conventional design, such as a sliding plate, and a lower collar 37 defining a bottom discharge opening 39 which is usually circular in horizontal cross section, and is equal in dimension to the minimum dimension of the charging hole 5. A slidable drop sleeve 41 around collar 37 moves into and out of engagement with the coke oven 1 at the charge hole 5 during charging, as is well known.

Located in collar 37 above gate means 35 is a replaceable restriction means 43 of this invention. Restriction means 43 restricts coal 45 flowing through collar 37 to a columnar mass 47 having a width 49 less than the interior width 11 of the coking chamber 3 and less than the dimension 9 of charging hole 5 to provide space 51 for moving the charging gases, which are the gases that are displaced by the incoming coal and the gases evolved from the coal that is exposed to the heated chamber 3. The restriction means 43 also reduced to the capacity of the existing aspiration system 27 the overall gas displacement rate by reducing the feed rate of incoming coal 45.

I prefer to locate restriction means 43 at the bottom of each hopper 25, but above gate means 35, so that restriction means 43 will be protected from the heat effect radiating from chamber 3 when hopper 25 is empty and gate 35 is closed. Otherwise, in principle restriction means 43 can be located below gate 35 but the heat effect may destroy the frictional properties of restriction means 43, which can cause arching of coal in restriction means 43.

As shown in FIG. 4, with the restricted coal column 47, gases can move freely in the spaces 51 between the column of coal 47 and the oven walls 53 the entire length of chamber 3 and thence up through ascension pipe 29 to main collector 31 of FIG. 3. Due to the ability of the gases to move freely to the aspiration means 31, there is no tendency for gases to become trapped in chamber 3 and build up pressure to cause seepage out through adjacent portals 55. The provision of space 51 is doubly important at the end of the chamber 3 which represents the narrowest chamber width because this end provides the greatest obstruction for changing gas flow. Also, the spaces 51 make it possible for the aspiration system 31 to operate effectively at a lower gas velocity, which is desirable to prevent carry over of coal particles.

As shown in FIGS. 4, 5, and 6, the restriction means 43 is a removable metal insert 44 having an outer portion 57 which contacts the interior surface of collar 37 and an inner surface 59 which defines an orifice 61, centered in the collar 37. The orifice 61 has a minimum dimension 63 aligned in the direction of the interior width 11 of coking chamber 3. Insert 44 is retained in collar 37 by short lengths of reinforcing bars 67 welded in collar 37. Thus, it can be understood that insert 44 can be placed in collar 37 by dropping insert 44 in through the hopper 25 to rest against reinforcing bars 67, and insert 44 can easily be removed or changed.

As can be seen in FIGS. 4–6, orifice 61 can be circular in horizontal cross section. A circular orifice 61 will restrict the column of coal 47 through 360°. The dotted lines of FIG. 4 show the outline of a circular orifice 61 projected onto the interior width of chamber 3. For circular orifice 61, inner surface 59 converges downwardly at a first angle 69 with the horizontal plane, to form orifice 61. For good flow of coal through orifice 61, first angle 69 should be equal to the second angle 71 made by the adjacent hopper wall with the horizontal plane. For hoppers having one wall portion at a steeper slope, or angle, than other wall portions, the portion of inner surface 59 adjacent the steep wall portion will have an equally steep slope, or angle, with the horizontal, and the inner surface 59 adjacent the less steeply sloped hopper wall portion will have an equally slanted slope, or angle, with the horizontal. Thus, it can be understood that for the circular orifice 61 inner surface 59 acts as an extension of wall 73 of hopper 25.

However, an alternate embodiment for increased coal flow is an orifice 61 which is elliptical in horizontal cross section as shown in dot-dash lines in FIG. 4 and in FIGS. 7–9. The minimum dimension 77 of the elliptical orifice 61 is aligned in the direction of the width of chamber 3, which is the same vertical plane 65 as the minimum interior width of chamber 3, to provide space 51 between wall 53 and coal column 47 while minimizing restriction of the coal column 47 along the second plane, in the direction of the length of chamber 3, which is perpendicular to the first plane.

As can be seen in FIG. 9, on a plane through the minimum dimension 77 of orifice 61, inner surface 59 is slanted at an angle to the horizontal equal to the angle with the horizontal made by the adjacent wall portion 73 of hopper 25. However, on a plane 79 through the maximum dimension of orifice 61 as shown in FIG. 8, inner surface 59 becomes parallel to outer surface 57 and the interior surface of collar 37. As can be seen from FIG. 4, elliptical orifice 61 restricts column of coal 47 in the plane 65 of the interior width of chamber 3 but has more space 81 for coal flow-through in a plane perpendicular to the interior width of chamber 3 than does circular orifice 61. Therefore, it will facilitate gas flow as well as coal flow.

As shown in FIG. 1, in an alternate embodiment, an additional path for removing the evolved and displaced gases can be provided by attaching a jumper pipe means 83 to collar 37 and connecting the jumper pipe 85 to the adjoining chamber 3 which is not being charged. Due to the restriction of the column of coal 47, the charging opening 5 which is usually completely blocked by the incoming coal 47, has space 87 between the oven and the coal, for gases to exit and pass through the jumper pipe 85. The jumper pipe 85 arrangement is optional, and the invention can be used without it to completely remove gases only via the collector main 31 of FIG. 3, as previously described.

The apparatus of this invention is particularly suited for use in a charging practice wherein all hoppers are emptied simultaneously. However, this invention can be used in a charging practice, known as Stage Charging, wherein the hoppers are emptied sequentially in a predetermined order.

It is preferred to supply the insert 44 of this invention for use with a hopper 25 having a collar 37 defining a bottom discharge opening 39, equal to (16) inches, a charge hole opening 5 of (16) inches, and a coking chamber 3 with interior width 11 of (17) inches or less at the narrowest end of the oven. Circular orifice 61 is (13) inches in diameter and elliptical orifice 61 has a maximum axis dimension 79 of (15½) inches and a minimum axis dimension 77 of (13) inches.

I claim:

1. In a gravity operated hopper for charging coal into a coking chamber through a charging hole, said hopper having a collar defining a bottom discharge opening equal in minimum dimension to the minimum dimension of said charging hole, gate means for opening and closing said hopper and a drop sleeve around said collar the improvement comprising:

a. replaceable restriction means in said collar for restricting the coal flowing through said collar to a columnar mass having a width less than the interior width of said coking chamber and less than the minimum dimension of said charging hole to provide space for exhausting gases during charging of said coking chamber;

b. said restriction means is an insert comprising:

i. an outer portion in contact with the interior surface of said collar;

ii. an inner surface defining an orifice with a minimum dimension aligned in the same vertical plane as the width of the interior of said coking chamber; and iii. means for retaining said insert in said collar.

2. The invention of claim 1 in which said hopper walls converge downwardly toward said collar at a first angle with a horizontal plane and said inner surface converges downwardly toward said orifice at a second angle with a horizontal plane, said second angle equal to said first angle.

3. The invention of claim 1 in which said orifice is elliptical in shape.

4. The invention of claim 1 additionally including jumper pipe means connecting said drop sleeve to an adjoining coking chamber.

5. In a gravity operated hopper for charging coal into a coking chamber through a charging hole, said hopper having a collar defining a bottom discharge opening equal in minimum dimension to the minimum dimension of said charging hole, gate means for opening and closing said hopper and a drop sleeve around said collar the improvement comprising;

a. replaceable restriction means in said collar for restricting the coal flowing through said collar to a columnar mass having a width less than the interior width of said coking chamber and less than the minimum dimension of said charging hole to provide space for exhausting gases during charging of said coking chamber;

b. said restriction means being an insert comprising:

i. an outer portion in contact with the interior surface of said collar;

ii. an inner surface defining an orifice with a minimum dimension aligned in the same vertical plane as the width of the interior of said coking chamber; and iii. means for retaining said insert in said collar;

c. said hopper walls converging downwardly toward said collar at a first angle with a horizontal plane and said inner surface converging downwardly toward said orifice at a second angle with a horizontal plane, said second angle equal to said first angle; and d. said orifice being centered within said collar above said gate means.

6. The invention of claim 5 in which said orifice is circular in shape.

* * * * *